US006789873B2

(12) United States Patent
Booth

(10) Patent No.: US 6,789,873 B2
(45) Date of Patent: Sep. 14, 2004

(54) INKJET PRINTER WITH NOZZLE MAINTENANCE SYSTEM RELOCATED BY MEDIA CARRIER

(75) Inventor: Andrew J. S. Booth, Qualicum Beach (CA)

(73) Assignee: Creo SRL, Burnaby (CA)

( * ) Notice: Subject to any disclaimer, the term of this patent is extended or adjusted under 35 U.S.C. 154(b) by 41 days.

(21) Appl. No.: 10/309,821

(22) Filed: Dec. 5, 2002

(65) Prior Publication Data

US 2003/0128250 A1 Jul. 10, 2003

(30) Foreign Application Priority Data

Dec. 5, 2001 (CA) ..... 2364401

(51) Int. Cl.[7] ..... B41J 2/165

(52) U.S. Cl. ..... 347/22; 347/29; 347/30; 347/33; 347/32

(58) Field of Search ..... 347/22–35

(56) References Cited

U.S. PATENT DOCUMENTS 5,757,398 A * 5/1998 Anderson ..... 347/32
6,361,141 B1 * 3/2002 Baitz ..... 347/32
6,663,215 B2 * 12/2003 Klausbruckner et al. ..... 347/22

FOREIGN PATENT DOCUMENTS

JP 59115863 * 4/1984
JP 02273243 * 7/1990

* cited by examiner

*Primary Examiner*—Shih-Wen Hsieh
(74) *Attorney, Agent, or Firm*—Oyen Wiggs Green & Mutala

(57) ABSTRACT

A maintenance system for an inkjet printhead is relocated to a position proximate the printhead to maintain the printhead. The relocation is performed by temporarily attaching the maintenance station to the media carrier of the inkjet printer. The maintenance station may be stowed in a docking station when it is not in use.

25 Claims, 4 Drawing Sheets

INKJET PRINTER WITH NOZZLE MAINTENANCE SYSTEM RELOCATED BY MEDIA CARRIER

CROSS REFERENCE TO RELATED APPLICATIONS

This application claims priority from Canadian Patent Application No. 2,364,401, filed on Dec. 5, 2001 which is hereby incorporated herein by reference.

TECHNICAL FIELD

The invention pertains to the field of inkjet printing and, in particular, to the maintenance of inkjet printheads.

BACKGROUND

Drop-on-demand or continuous-stream inkjet printers, such as thermal, piezoelectric, acoustic, or phase change wax-based printers, have at least one printhead from which droplets of ink are directed towards a printing medium (or substrate). Within such printheads, ink is typically contained in a plurality of channels. By means of power pulses, droplets of ink are expelled as required from orifices or nozzles at the end of these channels. The mechanisms whereby ink ejection works in these various types of machines are well established and will not be further discussed herein.

An inkjet printhead may be incorporated into a carriage type printer, a partial width array type printer, or a pagewide type printer. A carriage type printer typically has a relatively small printhead containing a number of ink channels and nozzles. The printhead can be attached to a disposable ink supply cartridge and the combined printhead and cartridge assembly is attached to a carriage. The carriage is reciprocated to print one swath of information (having a height equal to the length of a column of nozzles) at a time on a recording medium, which is typically maintained in a stationary position during the reciprocation. After the swath is printed, the paper is stepped a distance equal to the height of the printed swath or a portion thereof, so that the next printed swath is contiguous or overlapping therewith. Overlapping is often employed to address a variety of undesirable inkjet printing artifacts that may be traced to nozzle performance. This procedure is repeated until the entire page is printed.

In contrast, a pagewide printer includes a substantially stationary printhead having a length sufficient to print across the width or length of a sheet of printing medium. The printing medium is continually moved relative to the pagewide printhead in a direction which may be substantially normal to the printhead length. In most cases, the separation between individual nozzles is greater than the required dot spacing on the media, and hence the media may be passed under the pagewide printhead more than once in order to print at the interstitial positions or to address a variety of undesirable inkjet printing artifacts that may be traced to nozzle performance.

There is a need to maintain the ink-ejecting nozzles of an inkjet printhead. For example, the orifices typically need to be cleaned periodically and/or the printhead needs to be capped when the printer is out of use or is idle for an extended period. Capping the printhead prevents components of the ink in the printhead from evaporating and prevents contaminants from entering the printhead or contaminating the nozzle plate. There is sometimes a need to prime a printhead before use. This is done to insure that the printhead channels are completely filled with ink and contain no contaminants or air bubbles. Periodic priming may also be necessary to maintain proper functioning of the orifices. Maintenance and/or priming stations for the printheads of various types of inkjet printers are described for example, in U.S. Pat. Nos. 4,855,764, 4,853,717, and 4,746,938.

Various methods and apparatus for maintaining the condition of inkjet printheads are generally known in the art, as illustrated and described in the following references.

U.S. Pat. No. 5,206,666 to Watanabe et al., describes an inkjet recording apparatus having a full-line type recording head that is rotated between a recording position and a non-recording position. A cleaning member contacts the recording head during rotation of the recording head to remove deposited ink or foreign matter. In the non-recording position, the printhead is capped.

U.S. Pat. No. 5,257,044 to Carlotta et al., describes a cap actuation mechanism for an inkjet printhead maintenance station in a scanning type inkjet printer. A cap located on a cap carriage in the maintenance station provides the functions of printhead nozzle capping, priming, cleaning, and refreshing, as well as waste ink management.

U.S. Pat. No. 5,367,326 to Pond et al., describes a pagewide inkjet printer having a movable cleaning/priming station adapted for movement parallel to and along an array of printhead nozzles. The cleaning and priming station is slid along a ledge surface so that the cleaning and priming station is maintained a fixed distance from the face of the printhead.

A number of proposals suggest the use of media sheets for cleaning and maintaining inkjet printheads. For example, Japanese patent application JP 4141439A2 discloses a method for cleaning a printhead by pressing paper travelling through a printer against the printhead. Similarly, U.S. Pat. No. 4,947,190 suggests the use of an ink-absorbing cleaning sheet that is brought into contact with the printhead in order to wipe and clean the printhead. Other proposals for cleaning sheets have included sheets with specified surface roughnesses, adhesives, or absorbent or solvent-soaked pads (e.g., see U.S. Pat. No. 6,030,674, U.S. Pat. No. 5,589,865, U.S. Pat. No. 6,277,457, U.S. Pat. No. 5,751,306, U.S. Pat. No. 5,589,865).

Because media sheets work by coming into physical contact with the nozzle orifice plate, they can be made suitable for operations such as wiping off ink or debris or applying solvent. However, care must be taken to ensure that:

- contact with the orifice plate does not abrade or otherwise damage the surface;
- the action of the media sheet, or debris from the sheet itself, does not contribute to the clogging of nozzle orifices; and,
- the media sheet makes adequate contact with the surface to be cleaned.

Media sheets can be transported past the inkjet printhead along the existing media carrier path. However, it should be noted that rubbing and wiping printhead surfaces alone does not address all of the maintenance needs associated with inkjet printheads. Additional mechanisms for capping, priming, spitting, and/or suctioning the printheads will still be required for adequate maintenance. This requirement is reflected in U.S. Pat. No. 5,589,865, which discloses a cleaning sheet which has an opening in order to allow the passage of a separate vacuum wand.

As the technology has developed for fabricating ever higher resolution inkjet heads with ever greater densities of nozzles, and, more particularly, with the advent of pagewide systems, the requirements placed on maintenance systems have become even more complex. A typical maintenance system may include one or more of:

- a cap assembly to seal around an individual printhead or nozzle plate to keep the particular inkjet nozzle array from drying out and the nozzle plate free from contaminants;
- a wiper that can be moved to engage the nozzle surface of the printhead and clear away ink, debris and other undesirable matter from the surface of the nozzle plate area, and which may be moved away from the nozzle surface when wiping is not desired;
- a spittoon for receiving ink ejected from the nozzles to remove contaminated ink from the nozzles and to maintain less used nozzles;
- a selection of drive assemblies that may include a gear train for moving the cap, wiper and/or a spittoon;
- an absorption pad for absorbing drops of ink ejected during maintenance so that the printer may be transported without damaging or soiling parts of the printer with purged ink; and,
- a mechanism for cleaning the cap and wiper to prevent contaminants being transported onto the nozzle plate during successive maintenance procedures.

An inkjet printhead maintenance system can be a complex subsystem with many moving parts.

U.S. Pat. No. 6,179,403 to Xie describes a drum-based inkjet printing apparatus that includes a maintenance system located at one end of the print drum. The maintenance system includes assemblies that provide wet wiping of the nozzles of the printheads as well as vacuuming of the same printheads for maintenance thereof. The wet wipe nozzles are located within a stationary drum housing and extend through a plurality of apertures when necessary to provide maintenance functions. The printhead is mounted on a carriage which moves to the maintenance position, where the wet wipers apply a fluid to the inkjet nozzles such that any dried ink, viscous plugs or other debris is loosened on the front face of the inkjet printbars. Once the debris has been sufficiently loosened, a plurality of vacuum nozzles each extending through a plurality of vacuum nozzle apertures vacuum away any of the cleaning fluid as well as debris loosened thereby.

Other examples are known in the art, where a pad is attached to an extra-wide cylinder and the printhead is translated over a long distance to clear the nozzles over this pad.

While this approach addresses some of the requirements enumerated above, it nevertheless still requires the entire high precision printhead to be translated over a considerable distance to a service/maintenance position.

SUMMARY OF THE INVENTION

A maintenance system for an inkjet printhead assembly is relocated to the location of the inkjet printhead assembly to maintain the inkjet printhead assembly. The relocation is performed by temporarily attaching the maintenance station to the media carrier of the inkjet printer. The printing media carrier may also be moved to place the maintenance system in a position where it may itself be serviced by a docking station.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
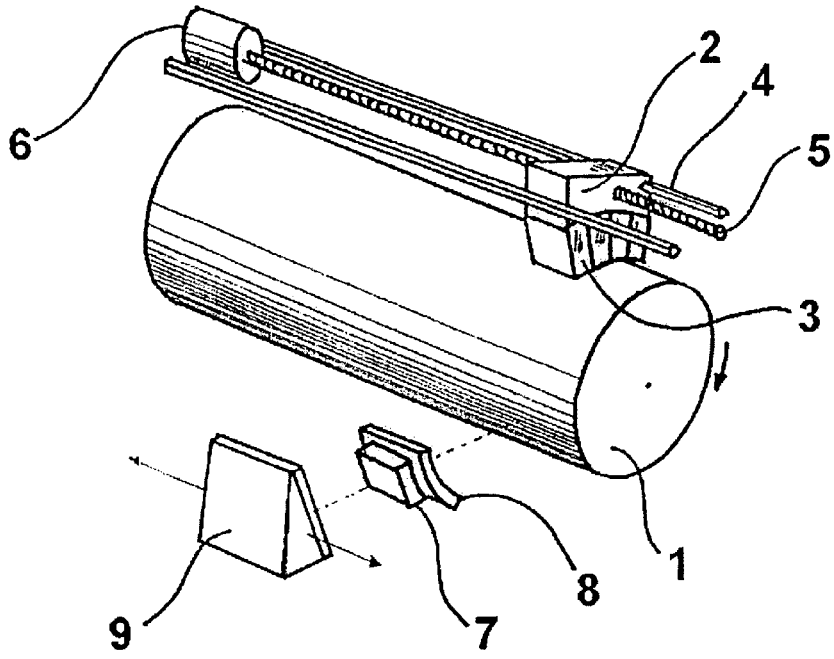
FIG. 1 shows an inkjet printer according to one embodiment of the invention.

FIG. 1 shows a cylinder-based inkjet printer with a partial pagewide inkjet printhead assembly according to one embodiment of the invention. The term inkjet printhead assembly is used herein to describe an inkjet printing head assembly that comprises one or more individual printheads. An inkjet printhead assembly typically has two or more individual printheads. The term individual printhead is used herein to describe an array of inkjet nozzles, typically fashioned as a integrated unit, having a common nozzle substrate, and served with ink either from an ink reservoir located within the integrated printhead, or via a hose system from an external ink reservoir.

Many commercial versions of such individual printheads are known and these may be combined by various methods to create an inkjet printhead assembly, some of these being described, for example, in U.S. Pat. No. 5,646,665 and No. 5,408,746 and in U.S. patent application Ser. No. 09/922,150. To the extent that the various designs for individual printheads are well known in the field, they will not be further described here, nor will the methods of combining them into inkjet printhead assemblies. The term partial pagewide inkjet printhead assembly is used herein to describe an inkjet printhead assembly that may include one or more of arrayed individual printheads, but which does not extend across the entire width of the widest media that the machine is capable of printing on.

Printing media carrier 1, being a cylinder in the case of this first preferred embodiment, is capable of carrying paper, transparencies or other sheet-like printing media. This printing media (not shown) may be of different sizes, textures and compositions. Inkjet printhead assembly 3 is mounted on printhead assembly carriage 2, which moves on linear track 4. Linear track 4 is arranged substantially parallel to the rotational axis of printing media carrier 1 and at such a distance as to allow inkjet printing by printhead assembly 3 on a sheet of printing media. Carriage 2 is translated along the width of printing media carrier 1 by the action of lead screw 5 and motor 6. A variety of other controlled translation mechanisms are also known in the art. Any suitable translation mechanism may be employed for the purposes of moving carriage 2 in a controlled fashion.

Relocatable inkjet printhead maintenance station 7 is mounted on a stage 8. When maintenance of inkjet nozzles is not required, this assembly of relocatable inkjet printhead maintenance station 7 and stage 8 is located in a storage location which may be within a docking station 9. Docking station 9 services relocatable inkjet printhead maintenance station 7. The term stow position is used herein to describe the position of maintenance station 7 when it is located within docking station 9.

To the extent that the various maintenance functions that may be performed by relocatable inkjet printhead maintenance station 7 require relocatable inkjet printhead maintenance station 7 itself to undergo regular service, docking station 9 may be equipped with facilities (not shown) to perform the servicing of relocatable inkjet printhead maintenance station 7.

The term inkjet printhead maintenance station is used herein to describe a unit that is used to clean, maintain and/or rejuvenate inkjet nozzles. It may contain, but is not limited to contain, facilities for performing one or more of the following operations:

applying vacuum to inkjet nozzles;

priming inkjet nozzles (priming may be a combination of applying vacuum and allowing a nozzle to spit);

capping inkjet nozzles;

providing a spittoon into which, or a surface onto which inkjet nozzles may spit;

wiping inkjet nozzles; and, blotting inkjet nozzles.

Such an inkjet printhead maintenance station is distinguished from a simple media sheet, which may be relocated by means of the media carrier to clean or wipe inkjet nozzles. By way of example, suitable inkjet printhead maintenance facilities that may optionally be included in relocatable inkjet printhead maintenance station 7 are described in U.S. Pat. Nos. 4,855,764, 4,853,717, and 4,746,938 and will not be further detailed here.

Figure 4:
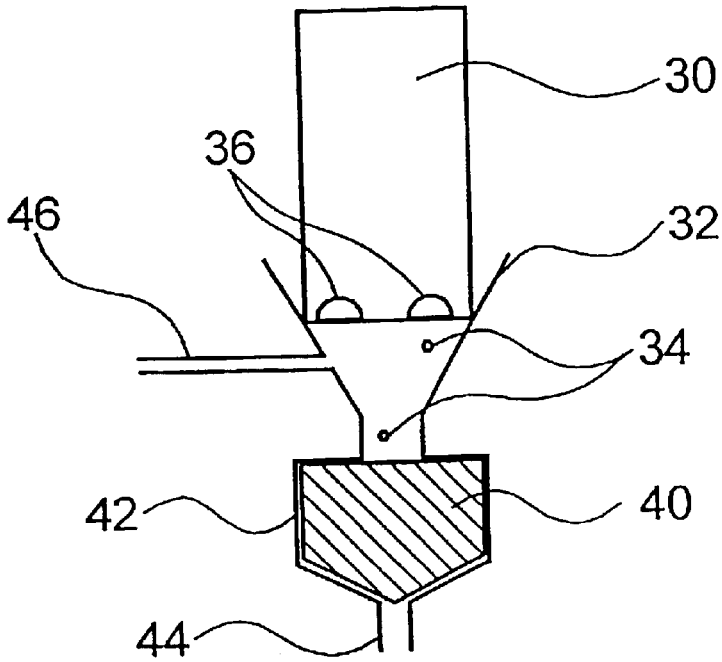

An inkjet printhead maintenance station may comprise one or more service heads, for example, Each service head may be configured to service one inkjet printhead. A schematic diagram of an example service head is shown in FIG. 4. A printhead 30 is in engagement with a funnel like capping arrangement 32. Inkjet fluid droplets 34 are ejected from printhead 30 at nozzle orifices 36 and are captured by absorbent material 40. Printhead 30 may have many such nozzles although this is not mandated. Where the nozzle is a continuous stream inkjet nozzle there may be only one or very few nozzles on each printhead. A shell 42 surrounds absorbent material 40 and a conduit 44 is connected to the lower end of the shell 42. Conduit 44 is connected to a vacuum source (not shown) that has the function of purging the jetted fluids accumulated in absorbent material 40 from the service head. Alternatively, shell 42 may be omitted and the jetted fluids may be allowed to evaporate from the absorbent material 40. In another alternative, cleaning fluid may be introduced into the capping funnel via a conduit 46. The cleaning fluid may soften or dissolve hardened inkjet products from nozzles of printhead 30.

The service head in FIG. 4 is shown by way of example only and many variations are possible. Commonly, the relocatable inkjet printhead maintenance station will comprise an array of service heads, so that a plurality of printheads may be serviced simultaneously. The array may include a number of service heads similar to that shown in FIG. 4.

When maintenance of one or more printheads is required, docking station 9 is moved such that stage 8 contacts printing media carrier 1. Stage 8 is temporarily attached to printing media carrier 1 at a chosen location. The location is within the "printing area" of printing media carrier 1. Various means of attachment are possible, including, but not limited to, mechanical, vacuum, magnetic and electromagnetic or combinations of these means. For example:

stage 8 may comprise a magnet which permits it to be removably attached to printing media carrier 1;

printing media carrier 1 may comprise a vacuum drum and stage 8 may comprise a surface which conforms to a surface of the vacuum drum so that it can be held in place by vacuum;

stage 8 may comprise a suction cup or the like and a connection to a vacuum source so that stage 8 can be held in place by vacuum; or, stage 8 may comprise one or more projections which are received in corresponding fittings on printing media carrier 1 so that stage 8 is mechanically held in place.

With stage 8 attached to printing media carrier 1, relocatable inkjet printhead maintenance station 7 is moved into alignment with a printhead to be maintained. This may be done by moving printing media carrier 1 and/or the printhead. In the illustrated embodiment, printing media carrier 1 is rotated, and carriage 2 is moved by means of leadscrew 5 and motor 6, the combined action of the two motions positions relocatable inkjet printhead maintenance station 7 in opposition to inkjet printhead assembly 3. This allows such maintenance actions as may be required at that time to be performed by relocatable inkjet printhead maintenance station 7.

Advantageously, either relocatable inkjet printhead maintenance station 7 or inkjet printhead assembly 3 may be moved towards the other in order to facilitate this function. Suitable actuators may be provided to move relocatable printhead maintenance station 7 away from stage 8 and toward inkjet printhead assembly 3. Additionally, or in the alternative, one or more actuators may be provided to displace inkjet printhead assembly 3 toward printhead maintenance station 7.

Printhead maintenance station 7 may be self contained. In some embodiments, printhead maintenance station 7 may require connection to external sources of power, control signals, cleaning fluids, compressed gases, vacuum, or the like. Such connections may be provided by way of a flexible umbilical cord containing wires, tubes, or other conductors which provide the desired connections.

Inkjet printhead assembly 3 can be serviced without requiring inkjet printhead assembly 3 to leave the range of motion of inkjet printhead assembly 3 which is traversed during normal full-width printing (or without moving inkjet printhead assembly 3 significantly in cases where inkjet printhead assembly 3 is fixed during printing).

The term "printing area" is used herein to describe the area defined by the longitudinal section of printing media carrier 1 that can be covered by inkjet printhead assembly 3 during normal full width printing. The printing area may extend substantially around the entire circumference of printing media carrier 1. The printing area of printing media carrier 1 is determined by the physical extent of inkjet printhead assembly 3 and the range over which it can travel during printing, and not by the presence or absence of media to print upon. The printing area comprises those parts of printing media carrier 1 which can be placed adjacent to printhead assembly 3 without moving printhead assembly 3 to a location outside of the range through which printhead assembly 3 could move during printing.

An alternative embodiment of the invention provides a translation system which can be used to place relocatable printhead maintenance station 7 onto printing media carrier 1 in a position such that it can be placed in opposition to inkjet printhead 3 without moving inkjet printhead 3 significantly. The translation system may, for example, permit docking station 9 to be moved parallel to the axis of printing media carrier 1. This arrangement allows inkjet printhead assembly 3 to maintain its location and the entire relocation process falls to the combination of docking station 9, stage 8, relocatable inkjet printhead maintenance station 7 and printing media carrier 1. This means that the high precision drive system of inkjet printhead assembly 3, which is optimized for precision and may comprise a high-precision lead screw, carries less of a systems burden.

Providing a separate translation system for moving docking station 9 permits operation in a manner which reduces the wear and tear on the high-precision drive system for printhead assembly 3. Any suitable translation system may be used. The translation system may comprise, for example, a translation arrangement of the type employed to translate inkjet printhead assembly 3. A variety of other translation mechanisms are also known and may be employed for this purpose.

The number of service heads on relocatable inkjet printhead maintenance station 7 may be sufficient to permit more than one printhead to be serviced simultaneously. The term service head is used herein to describe a unit that comprises an assemblage of one or more facilities required to maintain at least one printhead. Printheads for printing different colors may require different service heads. In a specific embodiment of the invention, relocatable inkjet printhead maintenance station 7 is equipped with an array of service heads that map one-to-one onto the printheads of an inkjet printhead assembly 3 comprising a plurality of printheads. This allows any number of the printheads, up to and including all of them, to be maintained simultaneously, if so required. In a more general embodiment, the array of service heads comprises a plurality of service heads and these service heads are used to service another plurality of printheads, without there being a specific numerical relationship between the two pluralities. Some service heads may be redundant and used in case of others failing. A given service head may service more than one printhead.

Docking station 9 may be adapted to maintain more than one service head on relocatable inkjet maintenance station 7 simultaneously, and, may indeed be so arranged as to maintain all of a plurality of service heads on inkjet maintenance station 7 simultaneously.

In the embodiment of the invention shown in FIG. 1, inkjet printhead assembly 3 is shown as a partial pagewide inkjet printhead assembly comprising four printheads with only one printhead per row substantially parallel to the cylindrical axis of printing media carrier 1. There may be more than one such row of one or more printheads. These printheads may be, by way of example, four different color individual printheads for the industry standard CMYK (cyan, magenta, yellow and black) colors. In a more general embodiment there is no limitation on the number of individual printheads, the combination of printed colors from the individual printheads, or other properties of the individual printheads. For example, individual printheads having different number of nozzles or different number of nozzles per unit distance may be employed.

In a further preferred embodiment, inkjet printhead assembly 3 has a plurality of printheads arranged in rows substantially parallel to the rotational axis of printing media carrier 1, and there may be more than one such row of printheads. The printheads in adjoining rows may also be staggered in their layout and/or rotated with respect to the rotational axis of the printing media carrier 1. In such an arrangement, inkjet printhead assembly 3, therefore, comprises an array of printheads that may extend in one or more directions. In this embodiment there is no limitation on the number of printheads, the combination of printed colors from the printheads, or other properties of the printheads. For example, printheads having different number of nozzles or different number of nozzles per unit distance may be employed.

In this embodiment, docking station 9 may be adapted to maintain more than one service head on relocatable inkjet printhead maintenance station 7 at the same time, and may be so arranged as to maintain all of the service heads on relocatable inkjet maintenance station 7 simultaneously. In addition, inkjet printhead assembly 3 may comprise an array of printheads extending in more than one direction for different colors, and may have a different number of printheads and a different arrangement of printheads for the different colors. This would be done to allow different colors, different combinations of colors, different ink drop sizes, different ink compositions, and/or different resolutions to be printed using fewer total number of heads than if all were to be done with the same number of heads. The arrangement of service heads in relocatable inkjet printhead maintenance station 7 may include service heads of any number and type up to and including a complete one-to-one mapping of service heads onto individual printheads. In this embodiment docking station 9 may be adapted to maintain more than one service head on relocatable inkjet printhead maintenance station 7 simultaneously and, may indeed be so arranged as to maintain all of the service heads on relocatable inkjet maintenance station 7 simultaneously.

In a further embodiment, the inkjet printhead assembly comprises an array of individual printheads with the array extending across the entire width of printing media carrier 1 in one dimension, and optionally having additional rows of individual printheads arranged at different angular positions concentrically with the circumference of printing media carrier 1. This embodiment of the invention constitutes a pagewide printer with multiple rows of individual printheads. In this embodiment the total amount of translation of printhead assembly 3 under the action of leadscrew 5 and engine 6 may be very small, and can therefore, be managed very accurately. Alternatively, printhead assembly 3 could remain stationary, in which case leadscrew 5 and engine 6 would only be required if print modes requiring translation of the printhead assembly were to be employed along with print modes that did not. For this reason, implementations wherein such a printhead is translated over long distances for the purposes of maintenance, are not preferred, as this would require, for example, a long and expensive, accurate leadscrew.

As with the previous embodiments, the number and type of service heads in relocatable inkjet printhead maintenance station 7 may be of any number and type up to and including a complete one-to-one mapping of service heads onto printheads. In this embodiment docking station 9 may be adapted to maintain more than one service head on relocatable inkjet printhead maintenance station 7 simultaneously and, may indeed be so arranged as to maintain all of the service heads on inkjet maintenance station 7 simultaneously.

Significantly, this embodiment of the invention allows an implementation of the invention in which docking station 9 is maintained at a fixed position. With a relocatable inkjet printhead maintenance station 7 that can have a one-to-one mapping of service heads onto individual printheads, the only translation required is totally within the normal printing movement range of inkjet printhead assembly 3. This significantly reduces the complexity of the maintenance system for the pagewide printer.

Figure 2:
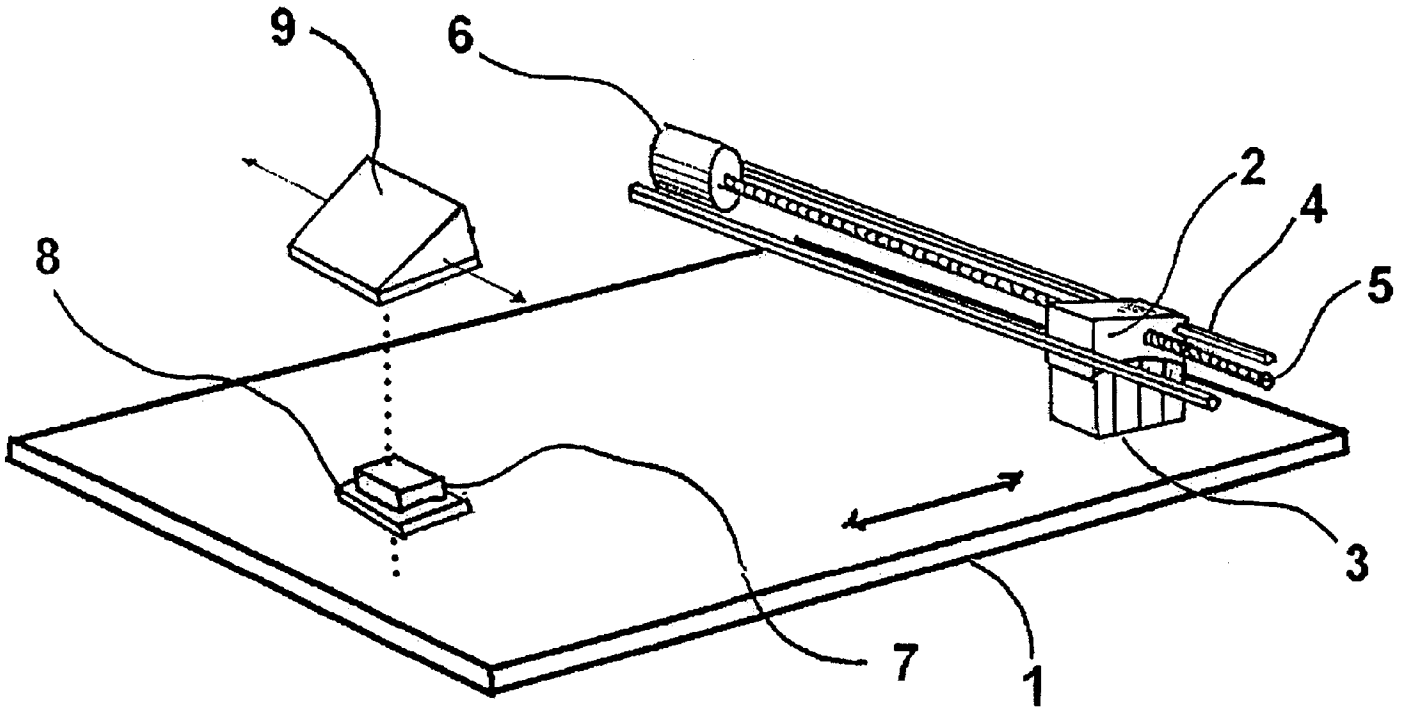
FIG. 2 shows a platen-based inkjet printer according to an other embodiment of the invention.

In yet a further embodiment of the invention, printing media carrier 1 comprises a platen in a flatbed printer arrangement. The term platen is used herein to describe a flat plate that is movable in at least one dimension within its plane, or on which printing media to be printed on is moved in at least one dimension within it's plane. This is shown in FIG. 2. All the aspects of the invention work in the same way as with the cylinder-based implementation, with the exception that the printing media carrier 1 is not rotated, but rather, translated, to position relocatable inkjet printhead maintenance station 7 proximate inkjet printhead assembly 3. In this embodiment, the printing area of the media carrier is again defined, in a first dimension, by the longitudinal section of printing media carrier 1 that is traversed by inkjet printhead assembly 3 during normal full width printing, and, in a second perpendicular dimension, by the full range of relative motion of the inkjet printhead assembly with respect to the platen. This area will substantially be a rectangle.

A further embodiment of the invention provides platen printers in which all the relative motion between platen and inkjet printhead assembly is performed by moving the inkjet printhead assembly in two dimensions while the platen remains fixed and stationary. The printing area is as defined as for the previous embodiment of the invention, except that both dimensions of the printing area are defined by the range of motion of the inkjet printhead assembly.

Figure 3:
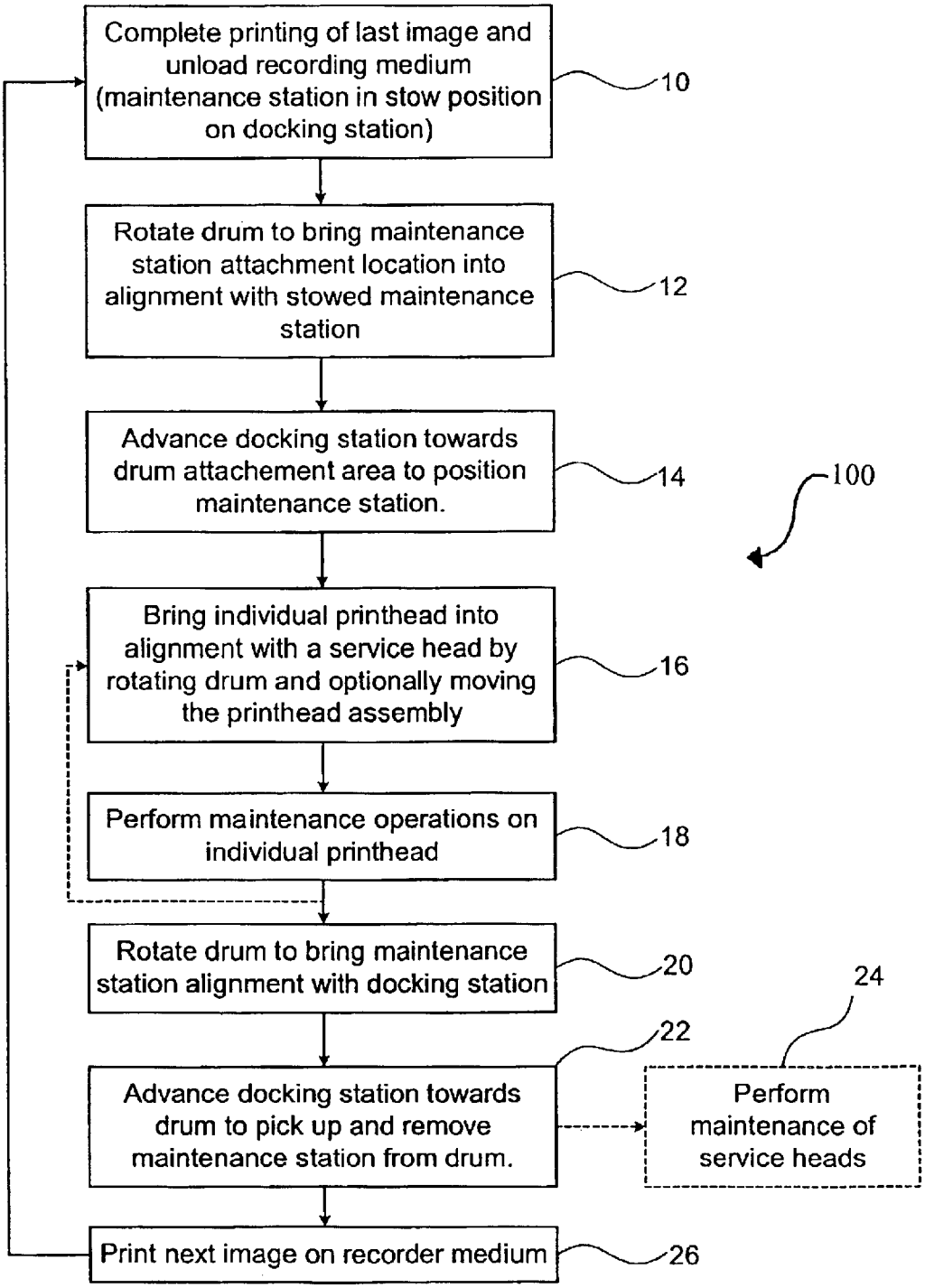
FIG. 3 is a flowchart illustrating a method according to the invention; and, FIG. 4 is a schematic depiction of one type of service head that may be used in apparatus according to the invention.

FIG. 3 illustrates a method 100 according to the invention. In step 10, on completion of the printing of an image, the recording medium is unloaded from the printing media carrier. At this time, the maintenance station is located on the docking station in the stow position. In this embodiment, where the printing media carrier is a drum, the drum is rotated to bring the maintenance station attachment location on the drum into alignment with the maintenance station in step 12. In step 14 the docking station is advanced towards the drum to place the maintenance station on the drum at an attachment location. Stage 8 is attached to the drum. The docking station is retracted and the maintenance station is now ready to perform maintenance operations in individual printheads.

Steps 16 and 18 will vary depending on the configuration of the printhead and the maintenance station. If there are less service heads than individual printheads the printhead assembly will typically move a particular subset of assemblies into alignment with the corresponding service heads in step 16 and then perform the maintenance operations in step 18. Steps 16 and 18 would then be repeated until all individual printheads have been serviced (or if desired, some subset of the individual printheads have been maintained). Where there is a one-to-one correspondence between individual printheads and service heads, step 16 would be unnecessary, and the maintenance operations would commence directly at step 18. When the printhead maintenance has completed the drum is again rotated (step 20) to bring the maintenance station to a location from where it can be retrieved and returned to the docking station in step 22. Step 20 may comprise aligning the maintenance station with the docking station. Step 22 may comprise advancing the docking station to retrieve the maintenance station from the drum.

Service head maintenance may optionally proceed as soon as the maintenance station is in the stow position in step 24. This step may include cleaning of service heads, unclogging or evacuation accumulated of inkjet fluids or other maintenance operations.

In yet further embodiments, other types of printing media carrier may be employed, including, but not limited to, platens that have shapes other than a flat plate. An example is a platen of which the curvature is substantially a sector of a circle. Such arrangements are particularly useful by virtue of the fact they are easier to translate, employing rotary means without the need for cumbersome mechanical arrangements.

The operation of apparatus according to the invention may be coordinated by a controller. The controller may comprising one or more processors. The processors may execute software instructions which cause the controller to operate actuators to cause the apparatus to operate as described herein. In the alternative, the controller may comprise suitable non-programmable logic circuits.

Preferred embodiments of the invention make optimal use of the translation assemblies that are fundamentally required for the printing process and thereby necessarily present. Printing apparatus according to the invention may be compact. Extra space is not required beyond the drive assemblies for the print media carrier and the precision drive of the inkjet printhead assembly. The maintenance system itself may be maintained while printing is proceeding. Providing a relocatable printhead maintenance station can reduce the demands on the highly accurate and very busy leadscrew drives of the printhead assembly, thereby reducing the wear and tear on the system. It furthermore reduces the length of the precision drive for the inkjet printhead assembly, thereby reducing cost.

Where a component (e.g. an assembly, block, device, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

Instead of moving the docking station to carry the relocatable inkjet printhead maintenance station into a position wherein it can be detachably attached to the printing media carrier as in the embodiments described in detail above a separate device may be provided to move the inkjet printhead maintenance station from the docking station to the printing media carrier.

There has thus been outlined the important features of the invention in order that it may be better understood, and in order that the present contribution to the art may be better appreciated. Those skilled in the art will appreciate that the conception on which this disclosure is based may readily be utilized as a basis for the design of other apparatus and methods which come within the invention. It is most important, therefore, that this disclosure be regarded as including such equivalent apparatus and methods as do not depart from the spirit and scope of the invention.

What is claimed is:

1. A method for maintaining at least one printhead of an inkjet printer, the method comprising:

non-permanently attaching a relocatable inkjet printhead maintenance station to a printing media carrier of the inkjet printer;

positioning the relocatable inkjet printhead maintenance station proximate the at least one printhead by moving the printing media carrier or the printhead or both the printhead and the printing media carrier; and, using the relocatable inkjet printhead maintenance station to maintain the printhead.

2. A method according to claim 1 comprising, after using the relocatable inkjet printhead maintenance system, removing the relocatable inkjet printhead maintenance system from the printing media carrier.

3. A method according to claim 1 wherein positioning the relocatable inkjet maintenance station comprises moving the printing media carrier.

4. A method according to claim 3 wherein the printing media carrier comprises a drum and moving the printing media carrier comprises rotating the drum.

5. A method according to claim 1 whererin non-permanently attaching the relocatable inkjet maintenance station to the printing media carrier comprises magnetically attaching the relocatable inkjet maintenance system to the printing media carrier.

6. A method according to claim 1 whererin non-permanently attaching to relocatable inkjet maintenance station to the printing media carrier comprises holding the relocatable inkjet maintenance system to the printing media carrier by way of a vacuum.

7. A method according to claim 1 wherein the relocatable inkjet maintenance system comprises at least one service head and the method comprises extending the service head away from the printing media carrier while the relocatable inkjet maintenance system is non-permanently attached to the printing media carrier.

8. A method for maintaining one or more individual printheads in an inkjet printer, the method comprising the steps of:

securing a printhead maintenance station to a printing media carrier at an attachment location within a printing area on the printing media carrier;

aligning the printhead maintenance station with the one or more individual printheads;

performing maintenance on the one or more individual printheads; and, removing the printhead maintenance station from the printing media carrier.

9. The method of claim 8 wherein the aligning step comprises moving one of:

the inkjet printhead assembly;

the printing media carrier; or both the inkjet printhead assembly and the printing media carrier.

10. The method of claim 8 wherein the method comprises moving a docking station to place the printhead maintenance station at the attachment location on the printing media carrier and disengaging the docking station from the printhead maintenance station before the aligning step.

11. The method of claim 10 comprising, after the retrieving step, performing maintenance on one or more service heads of the printhead maintenance station at the docking station.

12. A method for servicing a printhead in a printing apparatus having a print media carrier, the method comprising:

detachably affixing a printhead maintenance station within a printing area on the printing media carrier;

moving the printing media carrier, the printhead, or both the printing media carrier and the printhead until the printhead is positioned adjacent the printhead maintenance station;

servicing the printhead using the printhead maintenance station; and, subsequently removing the printhead maintenance station from the printing media carrier.

13. An inkjet printing apparatus comprising:

an inkjet printhead assembly having one or more inkjet printheads;

a relocatable printhead maintenance station;

a printing media carrier having an attachment location on the printing media carrier for detachably securing the printhead maintenance station; and, a docking station with the printhead maintenance station detachably located thereon, the docking station moveable toward and away from the attachment location on the printing media carrier.

14. The apparatus of claim 13 wherein the printing media carrier comprises a rotatable cylindrical drum and the inkjet printheads are aligned with the printhead maintenance station in the attachment location by one of:

a rotation of the cylindrical drum; or moving the printhead assembly; or a combination of a rotation of the cylindrical drum and a movement of the printhead assembly.

15. The apparatus of claim 13 wherein the printing media carrier comprises a flatbed platen and the inkjet printheads are aligned with the printhead maintenance station in the attachment location by moving one of:

the inkjet printhead assembly; or the printing media carrier; or a combination of the inkjet printhead assembly and the printing media carrier.

16. The apparatus of claim 13 wherein the inkjet printhead assembly comprises a first plurality of inkjet printheads and the printhead maintenance station comprises a second plurality of service heads, the second plurality being equal to or smaller than the first plurality.

17. The apparatus of claim 13 wherein the docking station comprises a mechanism for maintaining the service heads when the printhead maintenance station is in a stow position.

18. An inkjet printing apparatus comprising:

an inkjet printhead assembly comprising at least one inkjet printhead;

a relocatable inkjet printhead maintenance station;

a printing media carrier; and, a mechanism for non-permanently attaching the relocatable inkjet printhead maintenance station to the printing media carrier and subsequently detaching the relocatable inkjet printhead maintenance station from the printing media carrier.

19. An inkjet printing apparatus according to claim 18 comprising an actuator operable to move the media carrier to relocate the relocatable inkjet printhead maintenance station to a position proximate at least one printhead of the inkjet printhead assembly.

20. An inkjet printing apparatus according to claim 18 wherein the inkjet printhead assembly comprises a first number of inkjet heads, the relocatable inkjet printhead maintenance station comprises a second number of maintenance heads, and the second number is smaller than the first number.

21. A printing apparatus according to claim 18 comprising a control system configured to operate actuators to effect mounting of the maintenance station to the print media carrier and to subsequently cause the inkjet printhead assembly and print media carrier to move relative to one another until at least one printhead of the inkjet printhead assembly is proximate to the maintenance station.

22. A printing apparatus according to claim 18 wherein the relocatable inkjet printhead maintenance station comprises a stage and the stage comprises means for non-permanently attaching the relocatable inkjet printhead maintenance station to the printing media carrier.

23. A printing apparatus according to claim 22 wherein the printing media carrier comprises a curved surface and the stage comprises a surface curved to conform to the curved surface of the printing media carrier.

24. A printing apparatus as claimed in claim 22 wherein the stage comprises a magnet.

25. A printing apparatus as claimed in claim 22 comprising an actuator coupled between the stage and one or more service heads of the relocatable inkjet printhead maintenance station, the actuator operable to move the service heads away from the stage.

* * * * *